US008840483B1

(12) United States Patent
Steusloff et al.

(10) Patent No.: US 8,840,483 B1
(45) Date of Patent: Sep. 23, 2014

(54) DEVICE, SYSTEM, AND METHOD FOR EVALUATION OF A SWING OF A PIECE OF ATHLETIC EQUIPMENT

(75) Inventors: Patrick M. Steusloff, San Diego, CA (US); Thomas H. Lupfer, San Diego, CA (US)

(73) Assignee: Kinetek Sports, San Diego, CA (US)

( * ) Notice: Subject to any disclaimer, the term of this patent is extended or adjusted under 35 U.S.C. 154(b) by 0 days.

(21) Appl. No.: 13/244,141

(22) Filed: Sep. 23, 2011

Related U.S. Application Data

(60) Provisional application No. 61/386,362, filed on Sep. 24, 2010.

(51) Int. Cl.
*A63B 24/00* (2006.01)
*A63B 69/36* (2006.01)

(52) U.S. Cl.
USPC ..... 473/222; 473/221; 473/223

(58) Field of Classification Search
CPC ..... A63B 24/00; A63B 24/0003; A63B 24/0006; A63B 69/3632
USPC ..... 473/221–223
See application file for complete search history.

(56) References Cited

U.S. PATENT DOCUMENTS 3,792,863 A * 2/1974 Evans ..... 473/223
3,806,131 A * 4/1974 Evans ..... 473/223
5,082,283 A 1/1992 Conley et al.
5,184,826 A 2/1993 Hall, Jr.
5,395,116 A 3/1995 Blaakman
5,419,562 A 5/1995 Cromarty et al.
5,435,561 A 7/1995 Conley
5,616,832 A 4/1997 Nauck
5,743,690 A * 4/1998 Royle ..... 411/178
5,759,113 A * 6/1998 Lai et al. ..... 473/321
6,012,988 A 1/2000 Burke
6,030,109 A 2/2000 Lobsenz
6,196,932 B1 3/2001 Marsh et al.
6,402,634 B2 6/2002 Lee et al.
6,413,167 B1 7/2002 Burke
6,441,745 B1 8/2002 Gates
6,607,450 B1 8/2003 Hackman
6,649,905 B2 11/2003 Grenlund
6,753,778 B2 6/2004 Kruger
7,121,962 B2 10/2006 Reeves
7,800,480 B1 9/2010 Joseph et al.
7,801,575 B1 9/2010 Balardeta et al.
7,804,404 B1 9/2010 Balardeta et al.
7,831,212 B1 11/2010 Balardeta et al.
7,946,926 B1 * 5/2011 Balardeta et al. ..... 473/222
8,109,816 B1 2/2012 Grober (Continued)

*Primary Examiner* — Dmitry Suhol
*Assistant Examiner* — David Duffy
(74) *Attorney, Agent, or Firm* — Knobbe Martens Olson & Bear LLP

(57) ABSTRACT

This disclosure relates to an evaluation device and methods for evaluating the swing of a piece of athletic equipment. The evaluation device may include a microphone, an accelerometer, and a microcontroller configured to detect a stroke and ball strike and track the position of the athletic equipment in three-dimensional space. The evaluation device may also include a radio for wireless transmissions, a battery, and a sound tube connected to the microphone. The evaluation device can be used in conjunction with a host computer to store, and display data gathered by the evaluation device. In some methods, a stroke that is detected from a swing and a ball strike can be determined by comparing signals received from the accelerometer and the microphone to predetermined criteria.

21 Claims, 7 Drawing Sheets

(56) References Cited

U.S. PATENT DOCUMENTS

| | | | | |
|---|---|---|---|---|
| 8,137,208 | B2 * | 3/2012 | Ahem et al. | 473/221 |
| 8,142,304 | B2 * | 3/2012 | Reeves | 473/223 |
| 8,226,495 | B2 * | 7/2012 | Savarese et al. | 473/222 |
| 2002/0123386 | A1 * | 9/2002 | Perlmutter | 473/223 |
| 2007/0135237 | A1 | 6/2007 | Reeves | |
| 2007/0243947 | A1 | 10/2007 | Cheng | |
| 2009/0163287 | A1 | 6/2009 | Vald'Via et al. | |
| 2009/0209358 | A1 * | 8/2009 | Niegowski | 473/223 |
| 2009/0233735 | A1 | 9/2009 | Savarese et al. | |
| 2010/0093457 | A1 * | 4/2010 | Ahern et al. | 473/202 |
| 2011/0028230 | A1 * | 2/2011 | Balardeta et al. | 473/222 |
| 2011/0054782 | A1 * | 3/2011 | Kaahui | 701/208 |
| 2013/0065703 | A1 | 3/2013 | Rose | |
| 2013/0095939 | A1 | 4/2013 | Meadows et al. | |
| 2013/0203517 | A1 | 8/2013 | Bolane et al. | |

* cited by examiner

FIG. 1A
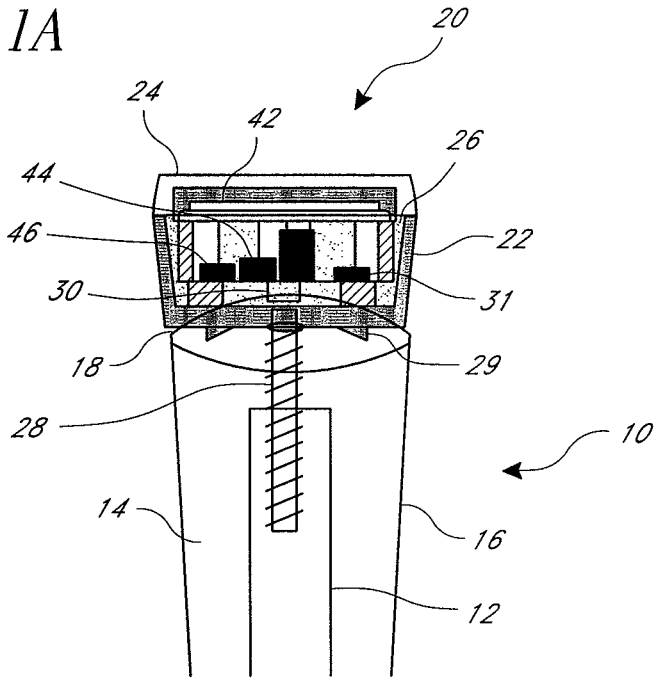
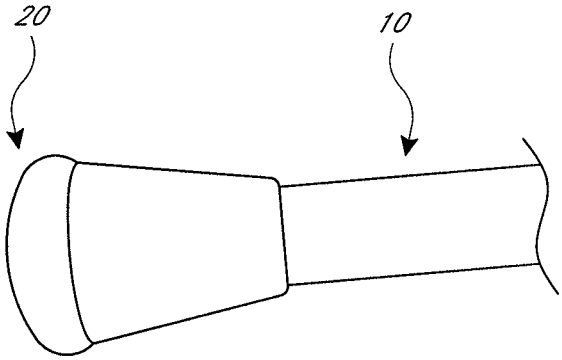
FIG. 1B

DEVICE, SYSTEM, AND METHOD FOR EVALUATION OF A SWING OF A PIECE OF ATHLETIC EQUIPMENT

CROSS-REFERENCE TO RELATED APPLICATIONS

This application claims the benefit of U.S. Provisional Patent Application No. 61/386,362, filed Sep. 24, 2010, the entirety of which is incorporated by reference herein.

BACKGROUND OF THE INVENTION

1. Field of the Invention

The present disclosure relates to the field of electronic bio-feedback. More particularly, the disclosure relates to systems and methods for evaluating the swing of athletic equipment.

2. Description of the Related Art

The ability of an athlete to perform at peak levels is limited by the ability of the athlete to understand their present performance in individual movements, as well as their performance during an overall game. In the game of golf, an individual's overall performance has been tracked by a scorecard, and performance of a specific individual movement has been taught by a coach. However, the ability of a scorecard or coach is limited in that a scorecard only provides the number of strokes needed to reach a hole, and a coach can only teach improvement to aspects of movement that he perceives and understands.

Attempts have been made to overcome the limitations of a scorecard and coach, including stroke logging programs. While these programs provide improved feedback to the user, as compared to a traditional scorecard, these programs have required the user to input each time he has made a stroke.

Attempts have also been made to improve accessibility of players to coaching and coaching tools. These have included the use of video-taping and other electronic sensing equipment. This equipment is, however, large, bulky, and stationary.

SUMMARY OF THE INVENTION

One embodiment is a device for measuring swing forces created by a piece of athletic equipment having an elongated shaft. In this embodiment, the device includes: a sensor configured to be mounted parallel to the longitudinal axis of the elongated shaft; an accelerometer configured to measure the movement of the athletic equipment in three dimensional space; and a transmitter configured to wirelessly transmit the data relating to the movement to a receiver.

Another embodiment is a system for tracking play along a golf course. In this embodiment, the system includes a sensor configured to be mounted to the longitudinal axis of a golf club and detect golf ball strikes, an accelerometer configured to measure the movement of the golf club in three dimensional space, and a transmitter configured to wirelessly transmit data relating to the ball strikes and the golf club movement to a mobile device.

Another embodiment is an electronic method of detecting a ball strike for a piece of athletic equipment. This embodiment includes: receiving movement data from the athletic equipment by sampling inputs from an accelerometer; comparing the sampled inputs to pre-determined values of a generic swing; sampling sensor inputs from a sensor located in a shaft of the athletic equipment; comparing sampled sensor inputs to pre-determined criteria of a ball strike; and detecting a ball strike when the sampled inputs from the accelerometer match the pre-determined values and when the sensor inputs meet the pre-determined criteria.

BRIEF DESCRIPTION OF THE DRAWINGS

FIG. 1A is a cross-section view of one embodiment of an evaluation device attached to a piece of athletic equipment.

FIG. 1B is a perspective view of one embodiment of an evaluation device incorporated into a sleeve attached to a piece of athletic equipment.

DETAILED DESCRIPTION

Figure 2A:
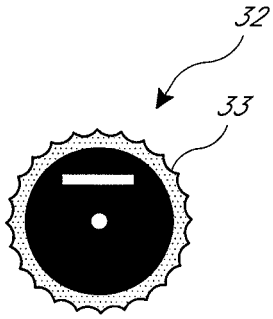
FIG. 2A is a top-view of one embodiment of an electronic module.

The following description and examples illustrate embodiments of the present invention in detail. Those of skill in the art will recognize that there are numerous variations and modifications of this invention that are encompassed by its scope. Accordingly, the description of one embodiment should not be deemed to limit the scope of the present invention. In this description, reference is made to the drawings wherein like parts are designated with like numerals throughout.

One embodiment is a device that is associated with the end of a club, and used to measure club movement before and after a ball strike. In some embodiments, the device is integrally formed with the club, attaches to the end of a club, attaches to an external surface of the club, or attaches to an internal surface of the club. In one embodiment, the club is a golf club, and the device is positioned in the grip end of the club. In this embodiment, the device may have a sensor that detects the strike of the ball. In one embodiment, this sensor can detect, for example, a sound wave, a pressure wave, vibration, or other detectable indicia of a ball strike. In one particular embodiment, this sensor is a microphone. The microphone can be placed in a variety of positions and orientations with respect to the shaft, including parallel, non-parallel, perpendicular, coaxial, non-coaxial, or any other desired position or orientation.

In one particular embodiment, a microphone is positioned longitudinally along the shaft and configured to detect when the club strikes a golf ball. In one embodiment, the microphone is positioned co-axial with the shaft and configured to detect when the club strikes a golf ball. In addition, the device may include an accelerometer that is configured to measure the movement in three dimensions before, during and after the detected ball strike. In one embodiment, the device may be configured with a microprocessor that receives inputs or signals from the accelerometer and the sensor inputs from the microphone and compares those inputs to predetermined criteria of a golf swing and a ball strike. In one embodiment, the microprocessor includes instructions that evaluate data from two seconds before to one second after the ball strike. In addition, the device can receive data from the accelerometer to determine other aspects of the golf swing, including the moment of the start of the backswing and the moment of transition from the backswing to the through swing. In addition, the device may include a battery that is configured to power the electrical components of the device. In one embodiment, the device may further have a radio transmitter or other communication equipment to communicate signals received from the accelerometer and the microphone to a handheld wireless device. In one embodiment, the device may have a unique device identifier, such as, for example, a MAC address, which allows association of stroke data with the particular club used to make the stroke. Additionally, some embodiments of the device are used with stroke logging software on the handheld wireless device, the stroke logging software configured to receive and to store signals from the device relating to the number of swings and ball strikes taken by a user.

Thus, in use, the evaluation device may be affixed to the grip end of a club, such as a golf club. The evaluation device includes a processing module configured to detect ball strikes and to then store the measured three-dimensional movement of the club before, during, and after the ball strike to a memory. A microphone located within the club is tuned to detect a ball impact. Following the detected ball impact, the processing module accesses accelerometer measurements taken a few seconds before impact, and a few seconds after impact. Those measurements can be analyzed by the processing module, and the results of the analysis can be transmitted to a host computer or smart phone, as discussed below, to help the user evaluate the position and movement of the club. In some embodiments, raw data can be transmitted for processing to a host computer or smart phone. By reviewing the data relating to certain components of a swing, a user can improve their game by determining those portions of their swing that may need to be changed to reach a more ideal swing profile In another embodiment, the host computer comprises stored programs and instructions for carrying out the methods described below. For example, the host computer may include modules or instructions for calculating ball strike events. In addition, the host computer may include analysis modules for analyzing the data from the evaluation device and providing swing plots as described below for review by the athlete. In one embodiment, the host computer is a mobile device with a display screen, and the evaluation device communicates via wireless transmitter to the mobile device. Thus, during game play, the mobile device may record and store ball strike detections, swing movements, and other data from the evaluation device that can be reviewed during or after the game by the athlete.

In some embodiments, the mobile device may include a GPS for tracking the position of the athlete during game play. In this embodiment, the mobile device includes tracking modules and instructions for capturing the position of the player during a ball strike or swing event. Then, later, the tracking module may calculate and display the entire game on a map displayed on a wireless device to the athlete that includes number of ball strikes, position on a course during each strike, and the swing features of each swing during game play. This ability to record an entire game on a mobile device would allow a player to later review each game stroke in order to find improvements to their game.

In some embodiments, a plurality of a golfer's clubs each have an affixed evaluation device. The evaluation device can be uniquely associated with the club to which it is affixed. In one embodiment, each club has a pre-stored unique identifier that is communicated with a host computer. In this embodiment, the evaluation device affixed to the club used in taking a stroke communicates information relating to the stroke as well as to the identification of the evaluation device to the host computer. The host computer can receive this information wired or wirelessly from the evaluation device and record information relating to the stroke as well as information relating to the specific club used for taking the stroke. Advantageously, this embodiment can provide information to the golfer relating to each club.

Some embodiments disclosed herein relate to a device for attachment onto the end of a piece of athletic equipment for evaluation of motion and ball strike, systems including such a device, and methods of using such a device to accurately determine a ball strike and to evaluate motion. In some embodiments, the device has a microphone, a microcontroller, and an accelerometer. In some embodiments, this device can include a wireless transmitter, a battery, and a sound tube. In some embodiments, a system including the evaluation device and a host computer are provided. In some embodiments, the device can communicate with the host computer via electronic wired or wireless transmissions. In some embodiments, a ball strike can be determined and a swing can be analyzed by comparing signals received from the accelerometer and the microphone to pre-determined values of a generic swing and a generic strike. In some embodiments the athletic equipment may be a golf club, a tennis racquet, or a baseball bat. In other embodiments, the athletic equipment may include a croquet mallet, a badminton racquet, or a cricket bat. However, a person skilled in the art will appreciate that the evaluation device, system, and methods of evaluating a swing and determining a ball strike disclosed herein can encompass a variety of aspects of an ideal swing in connection with a variety of pieces of athletic equipment. A person skilled in the art will further appreciate that the embodiments disclosed herein are not limited to the specific embodiments disclosed.

As discussed, a user or athlete can benefit from frequent and accurate feedback regarding performance over a game as well as performance of a specific movement or action. One device capable of providing such feedback is the evaluation device discussed below that detects timing and speed of motion, as well as providing insight into relative movement of the piece of athletic equipment throughout the motion. Evaluation of a swing and determination of a ball strike can be advantageously performed by an evaluation device located on a piece of athletic equipment.

FIG. 1A depicts a portion of a piece of athletic equipment 10 and an attached evaluation device 20. The piece of athletic equipment 10 can include a shaft 12 covered by a grip section 14 having a grip 16 and a grip end 18. The grip 16 can comprise a variety of materials, including rubber, synthetic, tape, metal, or natural materials. In embodiments in which the piece of athletic equipment 10 is a racquet, club, or bat, the grip section 14 can be cylindrical, with the grip 16 extending longitudinally along the outer circumference of the grip section 14. The grip end 18 in such an embodiment can be located at the termination point of the grip section 14.

In some embodiments, the evaluation device 20 can be affixed to the grip end 18 of the piece of athletic equipment 10. The evaluation device 20 can be designed with a width larger than, equal to, or smaller than those of the grip end 18 of the piece of athletic equipment 10. In embodiments of the evaluation device 20, the width of the device can approximate the width of the grip end 18 of the piece of athletic equipment 10, thus creating a smooth transition from the piece of athletic equipment 10 to the evaluation device 20. In some embodiments of the evaluation device 20 configured for use with a golf club, the housing can have a cylindrical shape with an outside diameter between one and one-and-one-half inches.

Similarly, the height of the evaluation device 20 can vary across a broad range of heights. In some embodiments of the evaluation device 20, the height of the device can be such that when installed onto the piece of athletic equipment 10, the device adds less than, for example, one inch of height to the piece of athletic equipment 10.

The evaluation device 20 can comprise a variety of shapes. In some embodiments, the evaluation device 20 can be generally cylindrical or shaped to conform to the shape of the grip section 14 of the piece of athletic equipment 10.

The evaluation device 20 can be made to cover a broad range of weights. In some embodiments of the evaluation device 20, the weight of the device can be limited so as to not substantially alter the weight or balance of the piece of athletic equipment 10.

The evaluation device 20 can be affixed to the piece of athletic equipment 10 in a variety of positions. In some embodiments of the evaluation device 20, the device can be positioned such that it is aligned with the longitudinal axis of the grip section 14 of the piece of athletic equipment 10, or, alternatively spaced apart from the longitudinal axis of the grip section 14 of the piece of athletic equipment 10. In some embodiments, and as depicted in FIG. 1A, the evaluation device 20 is aligned with the longitudinal axis of the grip section 14 of the piece of athletic equipment 10. A person skilled in the art will, however, recognize that the evaluation device 20 can be used in a variety of positions on the piece of athletic equipment 10 and that the present disclosure does not limit use of an evaluation device 20 to any specific position on the piece of athletic equipment 10.

Advantageously, attachment to the grip end 18 of the piece of athletic equipment 10 provides several benefits. By affixing the evaluation device 20 to the grip end 18 of the piece of athletic equipment 10, the device is located close to the hands of the athlete using the piece of athletic equipment 10. This advantageously shortens the lever arm over which the weight of the evaluation device 20 works, thus decreasing the moment exerted by the evaluation device 20 on the user. This advantageously decreases weight and size restrictions for the evaluation device 20. Additionally, by locating the evaluation device 20 close to the hands of the user of the piece of athletic equipment 10, the ultimate velocity of the evaluation device 20 can be lower, and thus, the magnitudes of accelerations to which the evaluation device 20 is exposed can be smaller. This decreased magnitude of acceleration advantageously decreases component durability and manufacturing requirements as the forces to which each of the components of the evaluation device 20 are exposed can be decreased. Additionally, the smaller magnitudes of acceleration advantageously decreases the range of acceleration across which the evaluation device 20 measures. Also, placement of the evaluation device 20 in proximity to the hands of the athlete places the evaluation device 20 relatively distant from the point of impact on the piece of athletic equipment 10 with the ball. This relative separation from the point of impact decreases the likelihood of accidental impact between the ball and the evaluation device 20, and also, due to the damping effect of the length of the piece of athletic equipment 10 between the point of impact and the evaluation device 20, the magnitude of vibrations, resulting from impact, to which the evaluation device 20 is exposed can be decreased. Finally, by locating the evaluation device 20 close to the hands of the athlete, the athlete's natural instinct to protect his hands will also advantageously protect the evaluation device 20.

As further depicted in FIG. 1A, some embodiments of the evaluation device 20 can include a housing 22 and a cap 24. The housing 22 and cap 24 can together define a hollow volume 26 in which components of the evaluation device 20 are held. The housing 22 and cap 24 can be joined together through a variety of methods. In some embodiments of the evaluation device 20, the cap 24 can be threadably fixed to the housing 22. In other embodiments, the cap 24 can snap fit or press fit into or onto the housing 22. A person skilled in the art will recognize that any method of fixation can be used to secure the cap 24 to the housing 22, provided that the attachment is sufficiently strong to resist the forces and vibrations associated with the use of the piece of athletic equipment 10.

Some embodiments of the cap 24 and the housing 22 can be further configured to be sealingly joined. Advantageously, such a sealing attachment can allow use of the evaluation device 20 in a variety of weather and environmental conditions, by preventing entrance of water, dirt, dust, or the like into the hollow volume 26 containing the components of the evaluation device 20. A person skilled in the art will recognize that this sealing attachment can be accomplished in diverse ways, including through use of an o-ring, gasket, silicon seal, or any other method of sealing.

In some embodiments, the cap 24 and the housing 22 are configured to withstand all of the forces associate with use of the piece of athletic equipment 10 for its intended athletic purpose, as well as forces associated with, for example, tossing a baseball bat after the batter hits the ball, tossing a piece of athletic equipment 10 in frustration, forcibly inserting a piece of athletic equipment 10 into a storage container, or accidentally throwing or dropping the piece of athletic equipment 10. A person skilled in the art will recognize that a variety of techniques and features may be used to increase the strength of the housing 22 and cap 24 and to protect the electronic components of the evaluation device 20, and that the present disclosure is not limited to any specific features or techniques of protecting the evaluation device 20.

The housing 22 can be configured with features to affix the housing 22 to the grip end 18 of the piece of athletic equipment 10. These features can include a variety of mechanical fasteners, adhesives, sleeves, covers, and ties. FIG. 1B depicts an embodiment of the evaluation device 20 configured to attach to the piece of athletic equipment 10 by a sleeve. In some embodiments, the evaluation device 20 can be formed into the grip section 14, the grip section 14 being attachable to the piece of athletic equipment 10. In other embodiments of an evaluation device 20, the device can be configured to allow the athlete to install and remove the evaluation device 20 from the piece of athletic equipment 10. In some embodiments, the evaluation device 20 can be integrally formed into the piece of athletic equipment 10. In some embodiments, the evaluation device 20 can be attached to an external surface of the piece of athletic equipment 10. In other embodiments, the evaluation device 20 can be attached to an internal surface of the piece of athletic equipment 10. In some embodiments, the evaluation device 20 can be configured to attach inside a shaft or handle to a piece of athletic equipment 10.

FIG. 1A depicts one embodiment of the evaluation device 20 in which a screw 28 affixes the evaluation device 20 to the piece of athletic equipment 10. The screw 28 can comprise a variety of diameters and threadings. In one embodiment, the screw 28 can have a diameter of approximately one-eighth inch. The screw 28 can also comprise a variety of lengths. In some embodiments, the screw 28 can be approximately one inch long. A person skilled in the art will recognize that the scope of the present disclosure is not limited to use of the screw 28 to affix the evaluation device 20 onto the piece of athletic equipment 10, nor to the specific dimensions of the screw 28.

As further depicted in FIG. 1A, and as in some embodiments, the screw 28 can be positioned on the housing substantially aligned with the longitudinal axis of the piece of athletic equipment 10. As further shown in FIG. 1A, in some embodiments of the screw 28, the screw 28 can penetrate the grip section 14 and extend down the shaft 12 of the piece of athletic equipment 10. The housing 22 can further include teeth 29. Teeth 29 can assist in securing the housing 22 of the evaluation device 20 to the grip end 18 of the piece of athletic equipment 10.

The housing 22 can be configured to hold components of the evaluation device 20. In some embodiments of the evaluation device 20, these components can include a microphone 30. The microphone 30 can assist in the evaluation of a swing and the detection of a ball strike by detecting noise and vibration in the piece of athletic equipment 10. In some embodiments, the microphone 30 is configured to detect noise and vibration caused by the strike of the ball by the piece of athletic equipment 10. The microphone 30 can be located in a variety of positions on the evaluation device 20. In some embodiments, the microphone 30 can be located in the hollow cavity formed by the cap 22 and the housing 24. In some embodiments, the microphone 30 can be located, so that when the evaluation device 20 is attached to the piece of athletic equipment 10, the microphone 30 is aligned with the longitudinal axis of the grip section 14 of the piece of athletic equipment 10. Such a configuration provides several advantages, including transforming the shaft 12 of the piece of athletic equipment 10 into a sound channeling pipe to insulate the microphone 30 from sounds external to the piece of athletic equipment 10 and to simultaneously direct sounds occurring within the piece of athletic equipment 10 to the microphone 30.

In some embodiments of the evaluation device, the microphone 30 can further include a sound pipe extending down the longitudinal axis into the shaft 12 of the piece of athletic equipment 10. Advantageously, the sound pipe can penetrate barriers existing in the shaft 12 of the piece of athletic equipment 10 to allow better transmission of sound to the microphone 30 and can increase the efficiency with which sound is channeled to the microphone 30. In embodiments, and as shown in FIG. 1A, the sound pipe can include a hollow screw 28 that serves dual purposes of attaching the evaluation device 10 onto the piece of athletic equipment 10 and channeling sound to the microphone 30.

The evaluation device 20 can further include an accelerometer 31 which provides inputs into the processor. The accelerometer 31 can assist in evaluation of a swing and detection of a ball strike by measuring the accelerations experienced by the accelerometer. These measurements can be used to evaluate tempo, timing, speed, and other aspects of a swing. Additionally, data collected from the accelerometer 31 can be stored to a memory and used to calculate the duration of the swing from the time of the start of the swing to the ball strike, and thus determine the overall swing duration. Further, in some embodiments, the velocity of portions of the piece of athletic equipment can be determined using data collected from the accelerometer in connection with dimensions of the piece of athletic equipment. Information relating to swing speed can be advantageously used to improve an athlete's performance in sports in which they react to a moving ball as higher swing speed enables response to a faster moving ball. Information relating to swing speed can also be advantageously used to improve an athlete's performance in sports in which the ball is stationary before impact and the distance of ball travel is ideally maximized.

The accelerometer 31 can be located in a variety of positions on the evaluation device 20. In some embodiments, the accelerometer 31 can be located in the hollow cavity 26 formed by the cap 22 and the housing 24. In some embodiments, the accelerometer 31 is located on the bottom of the hollow cavity 26 in the housing 24, placing the accelerometer 31 in close proximity to the grip section 14 of the piece of athletic equipment 10. In some embodiments, the accelerometer 31 is fixedly located relative to the housing 24.

A variety of accelerometers, or accelerometer configurations can be used in connection with the evaluation device 20 to determine movement data. In some embodiments, accelerometer 31 is selected so as sample the entire range of accelerations up to the moment of ball strike. In other embodiments for use with a putter golf club, the accelerometer 31 can have a range of, for example, +/−2 g, +/−4 g, +/−8 g, +/−12 g, or any other desired range. In embodiments for use with golf clubs other than a putter, the accelerometer 31 may be configured to measure a range of, for example, +/−2 g, +/−4 g, +/−8 g, +/−12 g, or any other desired range. A person skilled in the art will recognize that the selection of the accelerometer 31 is not limited to the specific ranges disclosed in herein, but is rather determined by the range of sampling required for the specific purpose of the accelerometer 31.

In addition to use of accelerometers sampling different ranges, accelerometers used in the evaluation device 20 can also sample movement data of the athletic equipment across a variety of different axes. In some embodiments, single axis, double axis, and triple axis accelerometers 31 can be used.

Some embodiments of an accelerometer used in the evaluation device 20 also provide a wide range of resolution limited only by the needs of the particular application of the evaluation device 20. In embodiments of an evaluation device 20 configured for use in connection with golf clubs, the accelerometer 31 can comprise twelve bits of resolution.

The evaluation device 20 can further include a battery 42. A variety of batteries can be used in the evaluation device 10. A person skilled in the art will recognize that the battery 42 should be selected to balance weight and size against power requirements of the evaluation device 10. In some embodiments, a coin cell battery can be used. Selection of other components can also impact battery 42 requirements as other components of the evaluation device 20 can be selected to use more or less power. Additionally, in some embodiments of the evaluation device 20, power requirements for the battery 42 can be minimized by programming the evaluation device 20 to operate in different power modes such as low and high power modes.

In one embodiment of the evaluation device 20, the device is programmed to operate in a low power mode until the piece of athletic equipment 10 is held in a pre-hitting orientation, at which point, the mode of the evaluation device 20 switches to a high power mode. In some embodiments, the battery 42 can be configured to be replaceable or rechargeable by the athlete. In other embodiments, the battery 42 can be sized, and evaluation device 20 components can be selected and programmed, to provide sufficient power for operation over some designated time frame. In the case of use of the evaluation device 20 in connection with golf clubs, the battery 42 and components can, in one embodiment, be designed to allow operation during three eighteen hole rounds of golf per week, over a three month period. A person skilled in the art will, however, recognize that the disclosure of this specification is not limited to a specific battery 42 and component power consumption configuration.

Some embodiments of the evaluation device 20, as depicted in FIG. 1A, further include a radio 44. A variety of radios can be used in an evaluation device 20. In some embodiments, the radio 44 can have a range of at least ten feet. Other embodiments of the evaluation device 20 can include a Bluetooth radio. A person skilled in the art will recognize that a radio 44 should be selected to balance weight, size, transmission ability, and range against power requirements of the radio 44, and that the present disclosure is not limited to a specific radio or radio configuration.

The evaluation device 20 can further include a microcontroller 46. The microcontroller 46 can be configured to control the various components of the evaluation device 20 throughout the various modes of operation. The microcontroller 46 can be located in a variety of positions on the evaluation device 20. In some embodiments, the microcontroller 46 can be located in the hollow cavity formed by the cap 24 and the housing 22. In some embodiments, the microcontroller 46 can scan the microphone 30 or the accelerometer 31 for signals. In some embodiments, the microcontroller 46 can compare the signals received from the accelerometer 31 or the microphone 30 to criteria for determining a swing and ball strike.

In other embodiments, when the comparison of the signals received from the accelerometer 31 or the microphone 30 match criteria for determining a swing and/or ball strike, the microcontroller 46 can signal the radio 44 to transmit information relating to the swing and/or ball strike to a host computer. The host computer can be any device capable of receiving a signal from the evaluation device 20, including a PDA, Smartphone, lap-top, PC, or other computing device. In some embodiments, the host computer can record and store information received from the evaluation device 20 for later review by the user of the evaluation device 20. A host computer can be further configured to transmit information received from the evaluation device 20 to another computing device. For example, an athlete could email or otherwise transmit information collected by a smart phone to a lap-top computer. This can beneficially enable the athlete to perform analysis on information collected from a game or training session, including statistical or other analysis.

Some embodiments of the evaluation device 20 can also be used in connection with video-taping or other sensing systems. Combined with the evaluation device 20, video-taping and other sensing systems can provide additional information about the athlete's movement and the swing of the piece of athletic equipment 10.

A person skilled in the art will recognize that the components of the evaluation device 20 can be connected to each other and to the evaluation device 20 in many ways. In one embodiment of the evaluation device 20, components of the evaluation device 20 can be connected by a circuit board, the circuit board being selected to match the sampling, processing, size, power consumption, and weight demands of the evaluation device 20.

Results received from use of the multiple axis accelerometer in the evaluation device can be improved by positioning the accelerometer in a pre-determined orientation relative to the athlete's grip on a piece of athletic equipment. As depicted in FIG. 2A, some embodiments of an evaluation device include an electronics module 32. The electronics module 32 can be configured to hold and support the components of the evaluation device and can be sized and shaped to fit into the hollow volume created by the evaluation device 20 housing and cap. In some embodiments, for example, an accelerometer or other electronic component is affixed to the electronics module 32. Some embodiments of the electronics module can include indexing features that fixedly orient the electronic module within the hollow volume. As further shown in FIG. 2A, some indexing features comprise a first set of ribs and slots 33 spaced radially around the outer surface of the electronic module, the ribs and slots 33 enabling a variety of rotationally indexed positions.

Figure 2B:
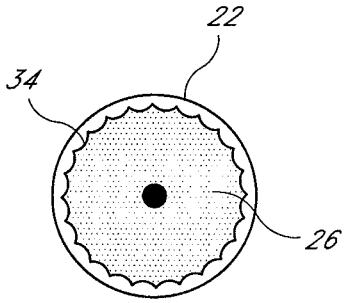
FIG. 2B is a top-view of one embodiment of a housing of an evaluation device.

FIG. 2B depicts a top view of one embodiment of the housing 22 configured for use in connection with the electronic module depicted in FIG. 2A. Similar to the housing 22 shown in FIG. 1, the housing 22 depicted in FIG. 2B defines hollow volume 26. Embodiments of the housing 22 configured for use with the electronics module can further include indexing features compatible with the indexing features of the electronics module. In the embodiment depicted in FIG. 2B, the indexing features comprise a second set of ribs and slots 34 sized and configured for compatibility with the first set of ribs and slots 33 on the electronics module. In one embodiment, both the electronics module and housing 22 include 72 ribs, thus creating a rotational resolution of five degrees.

In addition to features allowing indexing of the electronic module to the housing 22, some embodiments of the electronic module and the housing 22 can include features indicating desired indexing. Thus, in one embodiment of the evaluation device, the electronics module includes a feature indicating a proper orientation of the electronics module relative to the gripping position of the piece of athletic equipment by the athlete. In embodiments of the evaluation device configured for attachment to a golf club, the indexing feature indicates proper orientation of the electronics module relative to the orientation of the club face. Thus, the housing 22 is affixed to the grip end of the club, and the electronics module is inserted into the housing 22, the indexing feature indicating the proper orientation of the electronics module relative to the club face.

Figure 3:
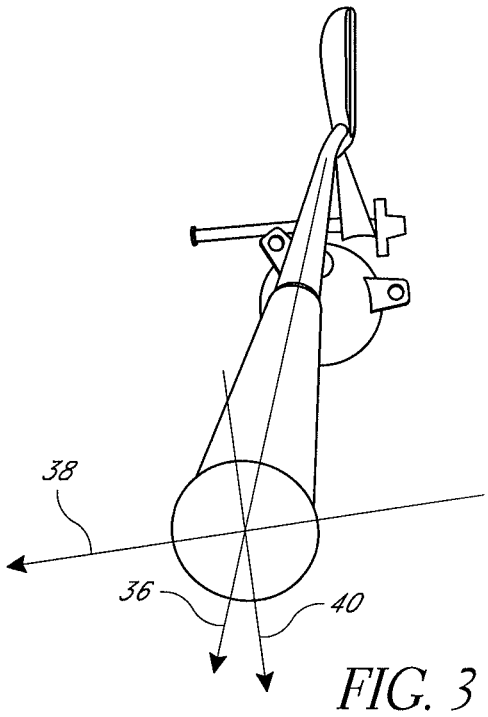
FIG. 3 is a perspective view of a golf club depicting the orientation of one embodiment of accelerometer axes.

FIG. 3 depicts one example of an embodiment of the orientation of the axes of a golf club. In some embodiments, and as depicted in FIG. 3, the axes of the golf club are aligned with the axes of the three-axis accelerometer of the evaluation device attached to a golf club. As shown in FIG. 3, the axes are oriented such that the positive Z-axis 36 extends from the evaluation device 20 and is aligned with the longitudinal axis of the shaft 12 inside the grip section 14 of the club towards the user, the X-axis 38 extends normal to the Z-axis 36 and parallel to the user's shoulders, and the Y-axis 40 extends from the evaluation device 20 and normal to both the X- and Z-axes. Advantageously, use of the three-axis accelerometer 31 can provide information relating to the path of the piece of athletic equipment 10, the relative motion of the athlete's body, and speed of the piece of athletic equipment 10 during the swing. A person skilled in the art will recognize that a variety of techniques can orient data received from an accelerometer or an evaluation device to a piece of athletic equipment and to break this data into directional components. A person of skill in the art will thus recognize that the present disclosure is not limited to any specific orientation of an evaluation device or its components in a piece of athletic equipment, or to any method of orienting the same.

Some embodiments of the evaluation device can determine the occurrence of swing and ball strike based on signals received from the accelerometer and the microphone. In some embodiments, both swing and ball strike can be simultaneously determined by comparing signals received from both the accelerometer and the microphone 30 to criteria for a swing and ball strike. In embodiments using the three axis configuration depicted in FIG. 3, a swing and ball strike are detected when a set of pre-determined criteria are met. In this embodiment, the microcontroller receives and stores data from the accelerometer and microphone. In some embodiments, an operating microcontroller continuously samples data and temporarily stores the most recent two seconds of data. In some embodiments, upon detection of an indicator of a possible swing exceeding a threshold, such as, for example, detection of an impulse, such as a sound wave, pressure wave, or vibration, exceeding a threshold, the microcontroller can be configured to store data for a designated time frame. In some embodiments, data for five seconds, three seconds, two seconds, one second, or any other desired amount of time prior to the indicator of the possible swing can be stored. In some embodiments, data for five seconds, three seconds, two seconds, one second, or any other desired amount of time after to the indicator of the possible can be stored. In some embodiments, data for and interval of time before and after the indicator of the possible can be stored. In some embodiments the microcontroller can be configured to sample data at 10 Hz, 50 Hz, 100 Hz, 500 Hz, or any other desired frequency. A person skilled in the art will recognize that the present disclosure is not limited to sampling or storing data over any specific time frame, but that that time frame can be adjusted to match the desired use of the device.

Collection, Processing, and Analysis of Evaluation Device Data to Determine a Swing More specifically, in some embodiments, data collected from the accelerometer and from the microphone is processed and analyzed to determine key aspects of a swing. In some embodiments, the data collected from the accelerometer can be recorded in three-axis form, namely, for an X-axis, for a Y-axis, and for a Z-axis. In some embodiments, this collected data is processed by smoothing raw data collected from the accelerometer and/or the microphone and creating a variety of processed data arrays. In some embodiments, data can be smoothed through the creation of a constant running average by averaging a smoothed data point with a designated number of smoothing data points collected both before and after the smoothed data point. In one embodiment, an array of smoothed data is created for data collected from each of the axes of the accelerometer. In one embodiment, a constant running average can be created by averaging each smoothed data point with the one point sampled immediately before and the one point sampled immediately after the data point, by averaging each smoothed data point with the two points sampled immediately before and the two points sampled immediately after the data point, by averaging each smoothed data point with the five points sampled immediately before and the five points sampled immediately after the data point, by averaging each smoothed data point with the ten points sampled immediately before and the ten points sampled immediately after the data points, or by averaging each smoothed point with any other desired number of points sampled immediately before and/or after each of the smoothed points. In some embodiments, smoothed data can be stored in a smoothed data array.

In some embodiments, the smoothed data can be used to determine the sum of the component accelerations measured at each sample point. In some embodiments, the sum of the component accelerations is determined by adding the value of each acceleration component at every sample point. Thus, the sum of the component accelerations for each sampled point equals the sum of the smoothed X-acceleration component at the sample point plus the smoothed Y-acceleration component at the sample point plus the smoothed Z-acceleration component at the sample point. A sum of the component accelerations can be calculated for each sampled point and can be stored in a sum of the component accelerations array.

In some embodiments, an array of the average of the sum of the component accelerations pre data and an array of the average of the sum of the component accelerations post data can be created. The array of the average of the sum of the component accelerations pre data can include a series of the average of the sum of the component accelerations pre values calculated by averaging the values of a desired number of points sampled immediately before the specific sample point. Thus, for an array of sample points S(1) . . . S(n), an average of the sum of the component accelerations pre value can be calculated for each of sample points S(1) . . . S(n). In some embodiments, the average of the sum of the component accelerations pre value can be the average of the two points sampled immediately prior to the sample point, the three points sampled immediately prior to the sample point, the five points sampled immediately prior to the sample point, the ten points sampled immediately prior to the sample point, or any other desired number of points sampled immediately prior to the sample point.

The array of average of the sum of the component accelerations post data can be similarly created to include a series of average of the sum of the component accelerations post values calculated by average the values of a desired number of points sampled immediately after the specific sample point. Thus, for an array of sample points S(1) . . . S(n), an average of the sum of the component accelerations post value can be calculated for each of sampled point S(1) . . . S(n). In some embodiments, the average of the sum of the component accelerations post value can be the average of the two points sampled immediately after the sample point, the three points sampled immediately after the sample point, the five points sampled immediately after the sample point, the ten points sampled immediately after the sample point, or any other desired number of points sampled immediately after the sample point.

In some embodiments, the arrays of average of the sum of the component accelerations pre and post data can be used to create an array of average of the sum of the component accelerations delta data. The array of average of the sum of the component accelerations delta data can comprise the difference between the average of the sum of the component accelerations post value (minuend) and the average of the sum of the component accelerations pre data (subtrahend) for each of the sample points.

The smoothed Z-axis accelerometer array can be used to create an array of average Z-axis pre data. The array of average Z-axis pre data can include a series of average total pre values calculated by averaging the values of a desired number of Z-axis points sampled immediately before the specific Z-axis sample point. Thus, for an array of sample points S(1) . . . S(n), an average Z-axis pre value can be calculated for each of sample points S(1) . . . S(n). In some embodiments, the average total pre value can be the average of the two points sampled immediately prior to the sample point, the three points sampled immediately prior to the sample point, the five points sampled immediately prior to the sample point, the ten points sampled immediately prior to the sample point, or any other desired number of points sampled immediately prior to the sample point.

The smoothed Z-axis accelerometer array can be used to create an array of average Z-axis post data. The array of average Z-axis post data can be similarly created to include a series of average total post values calculated by averaging the values of a desired number of Z-axis points sampled immediately after the specific Z-axis sample point. Thus, for an array of sample points S(1) . . . S(n), an average Z-axis post value can be calculated for each of sample points S(1) . . .

S(n). In some embodiments, the average total post value can be the average of the two points sampled immediately after the sample point, the three points sampled immediately after the sample point, the five points sampled immediately after the sample point, the ten points sampled immediately after the sample point, or any other desired number of points sampled immediately after the sample point.

In some embodiments, the arrays of average Z-axis pre and post data can be used to create an array of average Z-axis delta data. The array of average Z-axis delta data can comprise the difference between the average Z-axis post value (minuend) and the average Z-axis pre data (subtrahend) for each of the sample points.

The processed data gathered from the accelerometer and/or microphone can be used to determine components of a swing. The determination of these components of a swing can be used as a training tool, but can also be used to determine whether a swing has occurred. These components include aspects common to many or all swings. In some embodiments, these components include the period of time immediately prior to the begin of the swing, called setup, the start of the backswing, called takeaway, the end of the backswing and the beginning of the downswing (through swing), called transition, and the ball impact. Each of these swing components can be identified in data collected from the evaluation device, and the identification of one or several of these swing components can identify a swing. Thus, in some embodiments, the identification of any of the swing components may be sufficient to identify a swing, and in some embodiments, failure to identify any of the swing components may be sufficient to reject identification as a swing.

In some embodiments, a ball strike is determined by the registering of, for example, a sound or vibration impulse above a specified threshold. If an impulse above the specified threshold is detected, a ball strike is identified. In some embodiments, the predetermined criteria for the microphone can include criteria indicative of predetermined frequency, volume, duration, or other noise factors indicative of a ball strike.

When the microcontroller receives a signal from the microphone meeting predetermined criteria, the microcontroller begins evaluation of stored signals received from the accelerometer to determine whether a swing has occurred. One non-limiting embodiment of a method of evaluation of collected data is described below.

In some embodiments, the identification of data reflecting criteria associated with setup determines setup. These criteria can be based on assumptions about golf club positioning and motion during setup, as well as the temporal positioning of setup relative to a ball strike. In some embodiments, these assumptions can include, for example, that accelerations along the Z-axis are substantially constant for a certain length of time during setup, that the accelerations along the Z-axis remain above a designated threshold for a certain length of time during setup, and/or that setup occurs within a designated timeframe before ball strike.

Specifically, in some embodiments, a designated length of time can be, for example, 50 milliseconds, 100 milliseconds, 250 milliseconds, 500 milliseconds, 1 second, or any other or intermediate length of time. In some embodiments, accelerations along the Z-axis of a golf club during setup may vary by less than one percent, less than two percent, less than three percent, less than five percent, less than ten percent, less than twenty-five percent, less than fifty percent, or less than any other desired value. In some embodiments, setup criteria can specify an acceleration along the Z-axis of the golf club of at least 0.1 g, 0.2 g, 0.3 g, 0.39 g, 0.5 g, 1 g, or any other desired acceleration. In some embodiments, this acceleration arises due to gravitational acceleration and the positioning of the golf club. In some embodiments setup can occur within five seconds of the ball strike, within three seconds of the ball strike, within two seconds of the ball strike, within one second of the ball strike, within 0.5 seconds of the ball strike, or within any other time frame.

In one exemplary embodiment, data taken from two seconds before to 500 milliseconds before the ball strike is evaluated to determine the occurrence of setup. The data within this time range is evaluated to determine if a portion of the data covering 250 milliseconds has a Z-axis acceleration of at least 0.39 g and accelerations such that the absolute value of average Z-axis delta data for each data point is less than 0.058 g or is less than fifteen percent of the measured acceleration.

In some embodiments, takeaway can be determined by the identification of data matching criteria associated with takeaway. These criteria can be based on assumptions about golf club positioning and motion during takeaway, as well as the temporal positioning of takeaway relative to a ball strike. In some embodiments, takeaway can be identified at any period time before the ball strike, at any time before the ball strike and after setup, at any time more than two-hundred fifty milliseconds before ball strike and after setup, or at any other time frame. In one embodiment, takeaway is determined by examining data points within a designated time frame. In one embodiment, the average of the sum of the component accelerations delta data points for the designated time frame are evaluated. In one such embodiment, takeaway occurs at the earliest of the average of the sum of the component accelerations delta data points occurring after setup and up to two-hundred fifty milliseconds before ball strike that meets designated criteria. Specifically, takeaway can be identified at the earliest of the average of the sum of the component accelerations delta data points with a value less than 0 g, less than negative 0.01 g, less than negative 0.02 g, less than negative 0.05 g, less than negative 0.058 g, less than negative 0.1 g, less than negative 0.5 g, or less than any other value.

In some embodiments, transition can be determined by the identification of data matching criteria associated with transition. These criteria can be based on assumptions about golf club positioning and motion during transition, as well as the temporal positioning of transition relative to a ball strike. In some embodiments, transition can be identified in any period time before the ball strike, at any time before the ball strike and after takeaway, at any time more than one hundred milliseconds before ball strike and after takeaway, or at any other time. In one embodiment, transition is determined by examining data points within the designated time frame. In one embodiment, the average total delta data points for the designated time period are evaluated. In one such embodiment, transition occurs at the earliest of the average total delta data points occurring after takeaway and up to one hundred milliseconds before ball strike whose sign switches from positive to negative as compared to the sign of the immediately prior point of the average total delta data points. In some embodiments, the determination of transition can additionally require that the magnitude of change between the two average total delta data points exhibiting the sign reversal exceeds a predetermined threshold value. Advantageously, this requirement can minimize false positives. In some embodiments, this minimum threshold can be exceeded by a change greater than 0.01 g, 0.02 g, 0.05 g, 0.1 g, 0.5 g, 1 g, or any other or intermediate value.

Figure 4A:
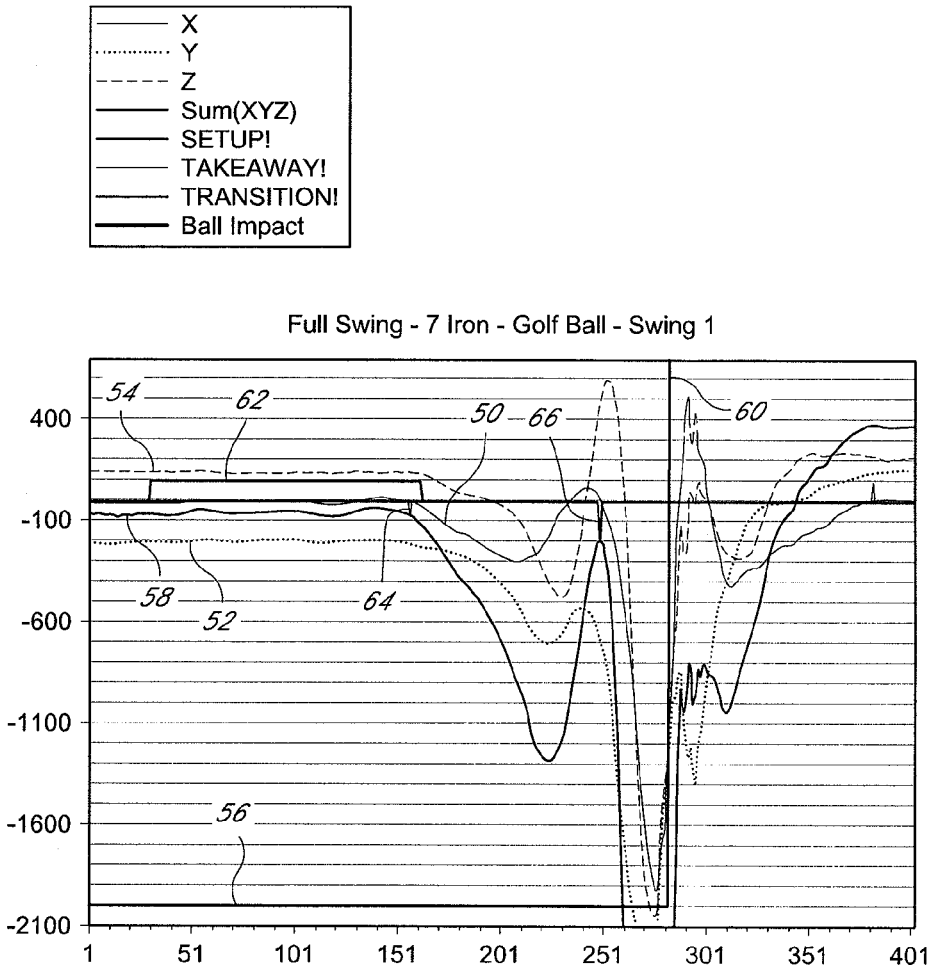
FIG. 4A is a chart depicting signals collected from an evaluation device relating to a swing and ball strike.
Figure 4B:
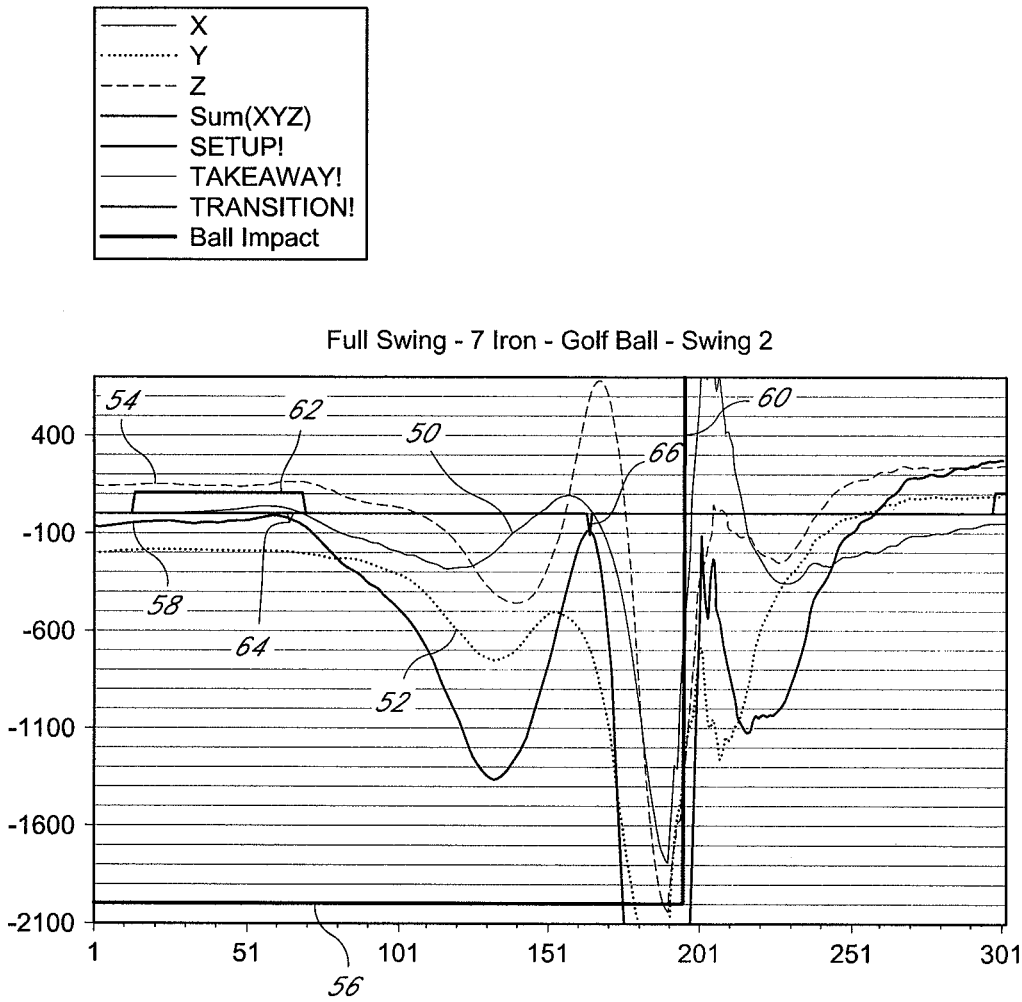
FIG. 4B is a chart depicting signals collected from an evaluation device relating to another swing and ball strike
Figure 4C:
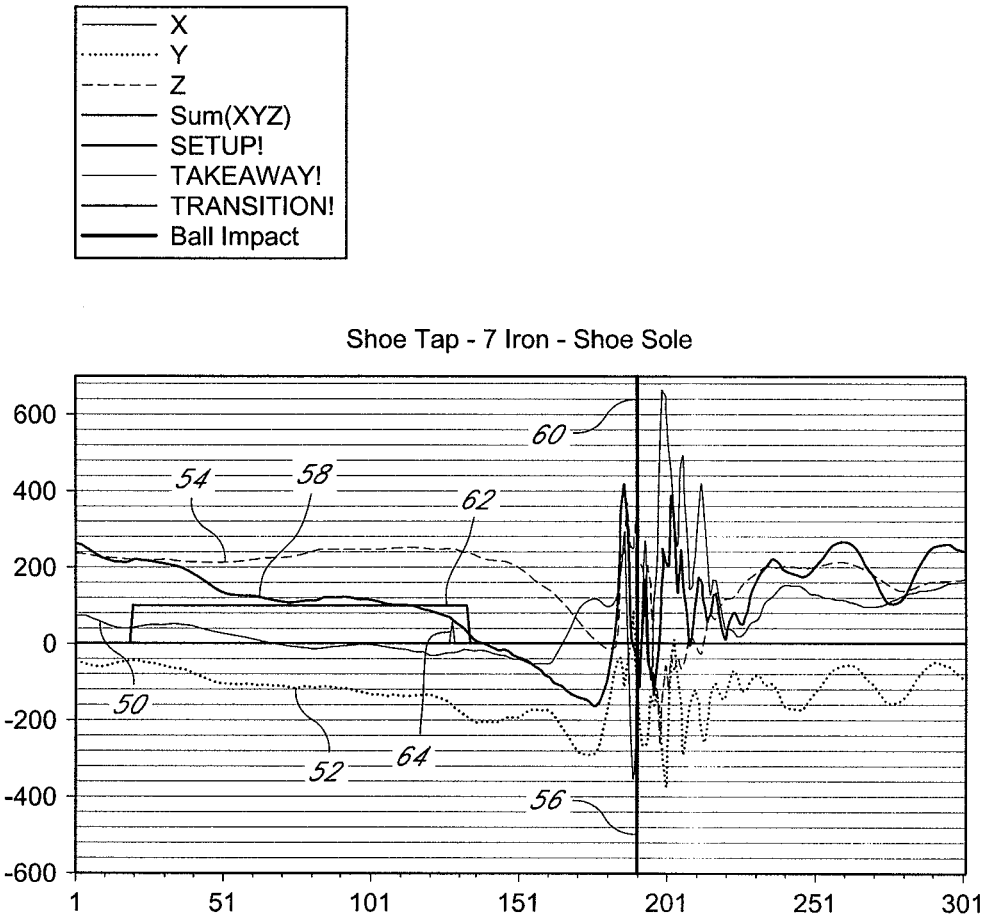
FIG. 4C is a chart depicting signals collected from an evaluation device relating to a non-swing and impact.

FIGS. 4A-4C depicts data collected from the microphone and the three-axis accelerometer in the evaluation device attached to the grip end of a golf club. FIGS. 4A-4C depict the smoothed X-axis signal 50 received from the accelerometer, the smoothed Y-axis signal 52 received from the accelerometer, the smoothed Z-axis signal 54 received from the accelerometer, a signal designating the instance of ball impact 56, and the sum 58 of the values of the smoothed X-, Y-, and Z-axis signals. FIGS. 4A and 4B further depict data collected from a swing and ball strike and thus depict the ball strike 60, setup 62, takeaway 64, and transition 66. In contrast, FIG. 4C depicts a non game-related swing followed by an impact, such as when a player knocks his club against his shoes. In contrast to FIGS. 4A-4B, the signals corresponding to FIG. 4C do not meet the criteria for a swing such as, for example, setup 62, takeaway 64, or transition 66, and as such, an evaluation device would not categorize these signals as a swing. Specifically, the signals depicted in FIG. 4C do not exhibit a valid transition, and thus do not meet the criteria for a swing.

Figure 5:
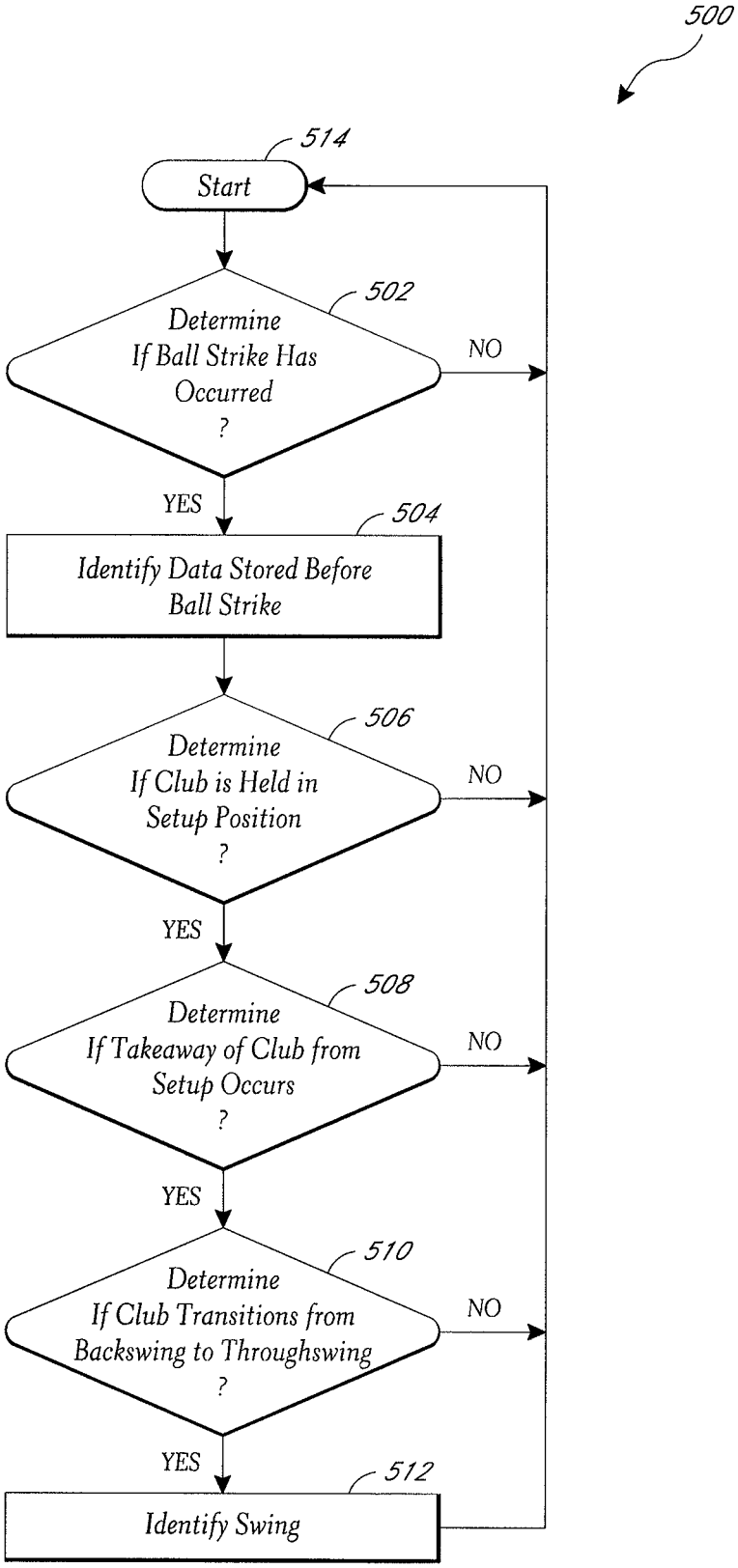
FIG. 5 is a flow chart depicting a method of determining a swing.

FIG. 5 is a schematic illustration of the process 500 running in a processing module and used in some embodiments of an evaluation device to identify a swing. Process 500 moves to a decision state 502 to determine if a ball strike has occurred. As discussed, a ball strike can be identified by measurement of an impulse, such as a sound, pressure, or vibration impulse, exceeding a threshold value. If a ball strike has not occurred, the process moves to block 514.

If a ball strike is determined, process 500 moves to block 504 and identifies a set of stored data that was collected before the occurrence of the ball strike. As discussed, this data set can comprise varying amounts of data, including data for 0.5 seconds before the ball strike, data collected during the second before the ball strike, data collected during the 2 seconds before the ball strike, data collected during the 5 seconds before the ball strike, data collected during the 10 seconds before the ball strike, or any other desired amount of data.

After identifying the desired data set, process 500 moves to decision state 506 to determine whether the club is held in the setup position that precedes a swing. As discussed setup can be identified when Z-axis accelerometer data exceeds a designated threshold for a designated time frame and when point-to-point variation in Z-axis accelerometer data is less than a threshold value. If the setup conditions are not met, then the club is not determined as being held in the setup position, and process 500 moves to block 514.

If the club is determined to be held in the setup position, process 500 moves to decision state 508 to determine whether takeaway of the club from the setup position occurs. In some embodiments, takeaway is identified at the earliest of the average of the sum of the component accelerations delta data points that exceeds a designated threshold. If the takeaway conditions are not met, takeaway is not identified, and process 500 moves to block 514.

If takeaway occurs, process 500 moves to decision state 510 to determine whether the club transitions from a backswing to a throughswing. As discussed, transition can be identified at the earliest positive-to-negative sign change between to consecutive average of the sum of the component accelerations delta data points. If the transition conditions are not met, transition is not identified, and process 500 moves to block 514.

If the transition of the club from backswing to throughswing is determined, process 500 moves to block 512 and a swing is identified. After the swing is identified, process 500 moves to block 514, where the evaluation device can continue to collect data, or where the evaluation device can stop collecting data.

In some embodiment, process 500 can terminate upon reaching block 514. In some embodiments, block 514 restarts process 500.

In addition to using data collected from the accelerometer to identify swing components and thereby identify a swing, data collected from the accelerometer can be used to determine the orientation of the accelerometer, and thus the evaluation device, relative to the golf club. By determining the orientation, the system described below can adjust the detected parameters so that the evaluation device can be mounted to the club in any rotational orientation, and still provide consistent swing data for evaluation. This orientation determination can be performed at various points throughout a swing, such as, for example, at ball strike, at setup, at takeaway, at transition, or at any other time. In some embodiments, the Z-axis of the accelerometer is co-axially aligned with the Z-axis of the golf club by the features that attach the accelerometer to the golf club. Assuming that the Z-axes of the club and of the accelerometer are co-axial, the orientation of the accelerometer relative to the club can be determined when the club is in setup. This determination is made with the assumption that a club in setup will experience most gravitational acceleration in its Y- and Z-axes. Thus, there will be little gravitational acceleration component in the club's X-axis. Additionally, as the Z-axis acceleration component ($A_Z$) is measureable due to the alignment of the club and accelerometer Z-axes, and as the acceleration of gravity ($A_g$) is known, the angle ($\alpha$) between the Z-axis and the vertical plane extending perpendicular to the surface of the earth can be determined as follows:

$$\alpha=\text{arccosine}(A_Z/A_g).$$

This angle ($\alpha$) can be used in combination with the acceleration of gravity ($A_G$) to calculate the Y-axis component ($A_Y$) of the gravitational acceleration as follows:

$$A_Y=A_G*\text{sine}(\alpha).$$

Alternatively, the Y-axis component ($A_Y$) can be calculated by taking the square root of the sum of the squares of the measured accelerometer X-axis component ($A_{AX}$) with the measured accelerometer Y-axis component ($A_{AY}$). Using either the calculated or measured Y-axis component ($A_Y$) and the measured accelerometer Y-axis component ($A_{AY}$), the angular displacement ($\beta$) of the Y-axis of the accelerometer relative to the Y-axis of the club can be calculated as follows.

$$\beta=\text{arccosine}(A_{AY}/A_Y)+T,$$

where T=0 when $A_{AX}<0$ and where T=180 when $A_{AX}>0$.

The angular displacement ($\beta$) can be used to calculate the club's X- and Y-axis acceleration components ($A_X$, $A_Y$) based on the accelerometer X- and Y-axis components ($A_{AX}$, $A_{AY}$) as follows:

$$A_X=(A_{AX}*\text{cosine}(\beta))+(A_{AY}*\text{sine}(\beta))$$

$$A_Y=(A_{AX}*-\text{sine}(\beta))+(A_{AY}*\text{cosine}(\beta))$$

These calculated club X- and Y-axis acceleration components can then be used in determining swing components no matter what rotational orientation the evaluation device positioned in with respect to the club. Further, calculation of these X- and Y-axis acceleration components is advantageous in that it increases the accuracy with which the evaluation device can determine swings without requiring a user to mount the evaluation device in a particular orientation. Thus, this calculation can advantageously simplify the installation and use of an evaluation device with a piece of athletic equipment. This allows the system to compensate for rotational displacement of the accelerometer around the longitudinal axis of athletic equipment by calculating a rotational angle of the accelerometer, and using the rotational angle to correct the raw movement data generated by the accelerometer.

Use of Evaluation Device in Connection with Stroke Logging Software

Some embodiments of the evaluation device can be used in connection with the host device and stroke logger software to automatically log each shot taken by a golfer. In these embodiments, a golfer can designate the start of stroke logging, after which time, the evaluation device can notify the host computer each time a swing and ball strike are detected. By only identifying a stroke when both a swing and ball strike are detected, the evaluation device prevents the recognition of practice swings or accidental club bumps into objects as strokes. Additionally, in some embodiments in which the host computer includes position identification capabilities, such as Global Positioning System (GPS) capability, the host computer can associate a GPS coordinate corresponding to the location of the detected stroke upon receiving notification of a stroke from the evaluation device. By locating the position of the stroke, the golfer can evaluate the distance and effectiveness of each of his shots. In some further embodiments, information relating to shot distance and stroke location can be graphically overlaid upon a graphical depiction of the golf course or golf hole. In some embodiments, each evaluation device is associated with a unique identifier, such as, for example, a MAC address, which allows the association of the evaluation device with a piece of athletic equipment. Thus, this unique identifier may be used to identify which golf club was used to make a stroke if each golf club is equipped with its own evaluation device. Advantageously, this information can be used by the golfer to evaluate performance during the golf game and to better select clubs for certain situations. Further, in addition to knowing the distance and effectiveness of his shots, a golfer may use information collected by the evaluation device to find a correlation between distance and direction of errant shots and deviations in his stroke from his ideal swing, such as, for example, deviations in the timing of takeaway and/or transition. Additionally, as each stroke is automatically logged when the evaluation device detects a stroke, the golfer cannot forget to enter a stroke.

Additionally, some embodiments of stroke logger software used in connection with the evaluation device can be configured to record the latest of detected strokes in the event that two or more strokes are detected at the same location. This embodiment advantageously decreases the likelihood of a practice swing being designated as a stroke. In some further embodiments, stroke logger software can be configured to allow manual input of a stroke.

Stroke logger software used in connection with the evaluation device can further provide feedback to the golfer relating to aspects of his swing or game while still practicing or playing. Thus, a player can be warned if his pace of play is too slow or too fast, or if some aspect of his swing is deviating from his ideal swing. In this way, the golfer can be provided with real-time feedback to adjust and improve his golf swing and golf game.

All references cited herein are incorporated herein by reference in their entirety. To the extent publications and patents or patent applications incorporated by reference contradict the disclosure contained in the specification, the specification is intended to supersede and/or take precedence over any such contradictory material.

The term "comprising" as used herein is synonymous with "including," "containing," or "characterized by," and is inclusive or open-ended and does not exclude additional, unrecited elements or method steps.

All numbers expressing quantities of ingredients, reaction conditions, and so forth used in the specification and claims are to be understood as being modified in all instances by the term "about." Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should be construed in light of the number of significant digits and ordinary rounding approaches.

The above description discloses several methods and materials of the present invention. This invention is susceptible to modifications in the methods and materials, as well as alterations in the fabrication methods and equipment. Such modifications will become apparent to those skilled in the art from a consideration of this disclosure or practice of the invention disclosed herein. Consequently, it is not intended that this invention be limited to the specific embodiments disclosed herein, but that it cover all modifications and alternatives coming within the true scope and spirit of the invention as embodied in the attached claims.

What is claimed is:

1. A device for measuring swing forces created by a piece of athletic equipment having an elongated shaft and a grip, the device comprising:

a housing configured to be mounted on an end of the grip, the housing comprising a base having a plurality of teeth configured to contact the grip;

a sensor configured to be mounted to the housing;

an accelerometer configured to measure the movement of the athletic equipment in three dimensional space;

a processor configured to compare the measured movement of the accelerometer to pre-determined values of a generic swing to determine a ball strike; and a transmitter configured to wirelessly transmit the data relating to the movement to a receiver.

2. The device of claim 1, wherein the elongated shaft is hollow.

3. The device of claim 1, wherein the accelerometer comprises a three-axis accelerometer configured to be mounted with an axis parallel to a longitudinal axis of the elongated shaft.

4. The device of claim 1, wherein the accelerometer is configured to measure accelerations over a +/−8 g range.

5. The device of claim 1, wherein the sensor is further configured to be mounted parallel to a longitudinal axis of the elongated shaft.

6. The device of claim 1, wherein the transmitter is a Bluetooth transmitter.

7. The device of claim 1, wherein the device further comprises instructions for entering a low-power mode.

8. The device of claim 7, wherein the lower power mode is entered until signals are received from the accelerometer indicating that the athletic equipment is in a predetermined position.

9. The device of claim 1, wherein the housing is further configured to mate with the grip end of a golf club.

10. The device of claim 1, further comprising a processing module configured to detect a ball strike by the athletic equipment.

11. The device of claim 1, wherein the device comprises a wireless radio for communication with a host computer.

12. The device of claim 1, wherein the sensor comprises a microphone.

13. The device of claim 1, further comprising a projection that is wherein the first tooth is further configured to rotatably couple with the end of the grip.

14. The device of claim 13, wherein the plurality of teeth are configured to assist with rotationally immobilizing the housing on the end of the grip.

15. The device of claim 13, wherein the projection comprises a hollow screw and the housing is configured to be mounted to the end of the grip through the hollow screw.

16. The device of claim 15, wherein the sensor comprises a microphone and the hollow screw acts as a sound pipe for channeling sound to the microphone.

17. A system for tracking play along a golf course, comprising:

a housing configured to be mounted on an end of a golf club grip, the housing comprising a base having a plurality of teeth configured to contact the grip;

a sensor configured to be mounted to the housing and detect golf ball strikes;

an accelerometer configured to measure movement of the golf club in three dimensional space;

a processor configured to compare the measured movement of the accelerometer to pre-determined values of a generic swing to determine a ball strike; and a transmitter configured to wirelessly transmit data relating to the ball strikes and the golf club movement to a mobile device.

18. The system of claim 17, further comprising a mobile device programmed to receive the data and display it on a display screen.

19. The system of claim 18, wherein the mobile device comprises a GPS receiver, and is configured to associate each ball strike with a GPS coordinate.

20. The system of claim 19, wherein the mobile device is programmed to display a map of a golf course, and place detected positions of ball strikes on the map.

21. The system of claim 17, further comprising a projection that is configured to rotatably couple with the end of the grip, wherein the plurality of teeth comprises a first tooth and a second tooth.

* * * * *

UNITED STATES PATENT AND TRADEMARK OFFICE

CERTIFICATE OF CORRECTION

PATENT NO. : 8,840,483 B1
APPLICATION NO. : 13/244141
DATED : September 23, 2014
INVENTOR(S) : Patrick M. Steusloff et al.

It is certified that error appears in the above-identified patent and that said Letters Patent is hereby corrected as shown below:

In the Specification

In column 3 at line 36, Change “profile” to --profile.--.

In column 11 at line 22, After “but that” delete “that”.

In column 15 at line 58, Change “to consecutive average” to --two consecutive averages--.

In the Claims

In column 19 at line 2 (Claim 13), Delete “wherein the first tooth is further”.

In column 20 at line 18 (Claim 21), Delete “wherein the plurality of teeth comprises a first tooth and a second tooth”.

Signed and Sealed this
Fourteenth Day of July, 2015

Michelle K. Lee

Michelle K. Lee
*Director of the United States Patent and Trademark Office*